United States Patent [19]

Rovinsky

[11] 4,324,054

[45] Apr. 13, 1982

[54] NIGHT LIGHT SLIPPER

[75] Inventor: William Rovinsky, Old Bethpage, N.Y.

[73] Assignee: Step-Lite Footwear Inc., New York, N.Y.

[21] Appl. No.: 162,813

[22] Filed: Jun. 25, 1980

[51] Int. Cl.[3] ..... A43B 23/00; A43B 7/02; A43B 3/28; G02B 5/12

[52] U.S. Cl. ..... 36/137; 36/2.6; 36/112; 350/98

[58] Field of Search ..... 36/137, 112, 2.6; 350/98

[56] References Cited

U.S. PATENT DOCUMENTS

| | | | |
|---|---|---|---|
| 2,572,760 | 10/1951 | Rikelman | 36/137 |
| 3,008,038 | 11/1961 | Dickens et al. | 36/137 |
| 3,067,322 | 12/1962 | Sala | 36/137 |

*Primary Examiner*—Patrick D. Lawson
*Attorney, Agent, or Firm*—Hubbell, Cohen, Stiefel & Gross

[57] ABSTRACT

A flexible child's slipper (10) has a night light (12) associated therewith which may be selectively actuated by each step of the child as the slipper (10) flexes with each step. The night light (12) includes a hollow transmissive three dimensional character rendition which contains an illumination apparatus (26) inside. The illumination apparatus (26) comprises a transparent waterproof housing (28) which is formed of plastic except for a rubber seal (30) forming part of the surrounding wall. The housing (28) contains a light source (32), a battery (34) and a switch (40). A resilient pusher member (50) having a protrusion (56) is mounted on the front portion (20) of the slipper (10) and is disposed adjacent the switch (40) to act on the switch (40) and close it through the seal (30) during each step to illuminate the light source (32). A day/night mode switch (44) is provided to selectively disable the operation of the light source (32) to prevent its operation by the flexure switch (40) by disrupting electrical contact with the battery (34) in the day mode.

12 Claims, 6 Drawing Figures

NIGHT LIGHT SLIPPER

TECHNICAL FIELD

The present invention relates to children's slippers having illumination means associated therewith.

BACKGROUND ART

The use of illumination in a shoe is well known in the art, such as exemplified by U.S. Pat. Nos. 3,800,133; 2,931,843; 4,014,115; 4,020,572; 4,158,922; 1,933,243; 4,130,951; 4,128,861; 4,112,601; 3,946,505; 3,008,038; 2,976,622; 3,067,322 and 2,572,760. The above patents are exemplary of a multitude of different types of arrangements for providing illumination in a shoe. However, none of these prior art arrangements known to applicant provides a child's slipper in which a recognizable character rendition which comprises a child's night light is capable of being periodically illuminated with each step by the child so that the night light accompanies the child during step by step traversal of a path, nor such an arrangement in which a night light is selectively actuated by direct flexing movement of a switch in conjunction with the flexing of the bottom sole portion of the slipper during each step by the child. Moreover, none of the above prior art arrangements readily enables a day/night mode for permitting the light source operation to be selectively disabled during the daytime when the aforementioned night light is not normally desired and enabled during the nighttime when the accompanying night light is desired by the child. Furthermore, there are no such prior art arrangements known to applicant in which a substantially transparent housing for the light source and battery includes a rubber seal interface disposed between the switch and switch actuator for providing a waterproof housing in which electrical closure of the switch is obtained through the rubber seal so as to enable the housing interior to remain insulated from ambient during electrical closure of the switch. This concept is particularly important in a child's slipper where safety is of the utmost consideration. Thus, the sealed housing prevents moisture from entering and shorting the electrical contacts while at the same time preventing leakage of potentially harmful battery acid therefrom.

Although U.S. Pat. No. 2,572,760, referred to above, discloses an illuminated shoe having a step type of switch, the switch is not one in which there is direct flexing action to close the switch nor one in which a rubber seal interface is employed to waterproof the housing and enable electrical closure of the switch through the rubber seal interface. Rather, the device disclosed in this reference is an elaborate ball type arrangement in which the ball is moved so as pivot a lever with each step or, alternatively, a spring switch in which a spring at the end of a rod is compressed by contacting the ground each time a step is taken. Neither of these arrangements is satisfactory for providing a child's slipper of the type referred to above. Similarly, U.S. Pat. No. 3,067,322, referred to above, discloses a light which may clip onto a slipper; however, once the foot is placed in the slipper, the light continually remains on draining the battery. Moreover, there is no disclosure or suggestion of the aforementioned rubber seal interface which waterproofs the housing and enables periodic electrical closure of the switch through the rubber seal interface.

Thus, although the prior art known to applicant as referred to above is quite diverse, applicant is not aware of any satisfactory children's slippers capable of providing a periodically illuminable night light with each step by the child. This is particularly important to young children to whom a night light in the form of a recognizable character provides reassurance if the child should awake during the night and must leave the bedroom, such as to go to the bathroom. Moreover, such a device will encourage the child to wear the slippers during the time when they are most needed.

DISCLOSURE OF THE INVENTION

A child's slipper is provided having illumination means associated therewith for lighting a path to be traversed by the slipper as the child wearer travels along a walking surface step by step for providing a night light which accompanies the child wearer during such path traversal. A resilient pusher member is mountable in the front portion of the slipper for direct flexing movement in conjunction with the flexing of the slipper bottom sole portion during each step by the child with the pusher member being disposed adjacent a switch for actuating the switch during each flexure of the pusher member so as to close the switch. The switch forms part of an electric conduction path between a light source and a battery source for powering the light source. The night light, which includes the light source, comprises a light transmissive three dimensional hollow recognizable character rendition which is illuminated each time the light source is illuminated. Thus, the recognizable character rendition comrising the aforementioned child's night light is capable of being periodically illuminated with each step by the child. The light source, battery and switch are contained in a housing which comprises a surrounding wall which includes a resilient seal interface member, such as rubber, disposed between the switch and the resilient pusher member for sealing the housing interior to ambient whereby the rubber seal provides both a waterproof housing and enables electrical closure of the switch through the rubber seal. The balance of the surrounding wall preferably comprises a light transmissive medium, such as plastic. The housing may be hinged so as to enable removal and replacement of the battery source or may be removable mounted to the slipper, such as by a spring clip. A second switch or other disabling mechanism may preferably be provided for selectively disabling the operation of the light source so as to prevent completion of the electrical conduction path by closure of the other switch, thereby providing a day/night mode for permitting the light source operation to be selectively disabled during the daytime when the night light is not normally desired and enabled by the pusher member during the nighttime when the accompanying night light is normally desired by the child.

BEST MODE FOR CARRYING OUT THE INVENTION

Figure 1:
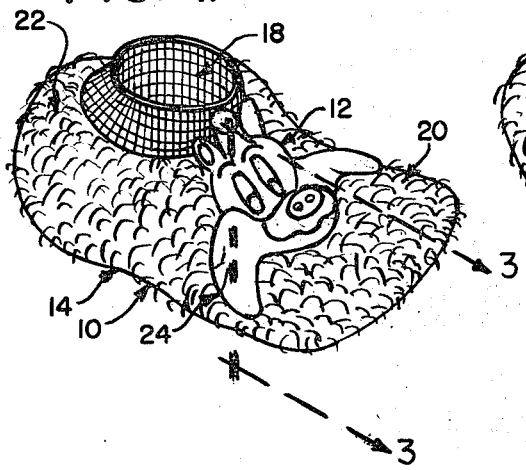
FIG. 1 is a perspective view of a child's slipper in accordance with the present invention.
Figure 2:
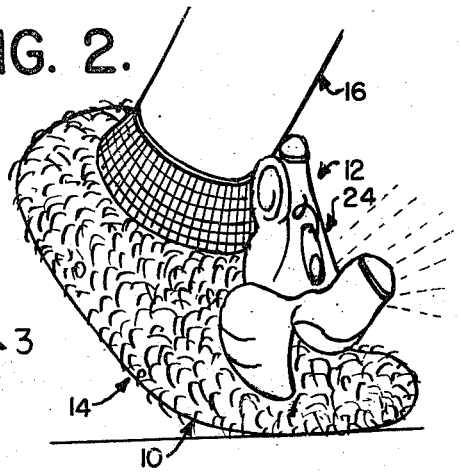
FIG. 2 is a diagrammatic illustration of the slipper of FIG. 1 in use.

Referring now to the drawings in detail and initially to FIGS. 1 and 2 thereof, the presently preferred embodiment of a child's slipper, generally referred to by the reference numeral 10, having a night light generally referred to by the reference numeral 12 which accompanies the child so as to be periodically illuminated with each step by the child, as illustrated in FIG. 2, is shown. The slipper 10 is preferably of the type having a flexible bottom sole portion 14 which bends with each step by the child as illustrated in FIG. 2. As shown and preferred, the slipper 10 forms a pocket for the foot 16 of the wearer when the foot is inserted through opening 18 in the slipper 10, with the pocket for the foot 16 being formed by the front portion 20 and rear portion 22 of the slipper 10.

Figure 3:
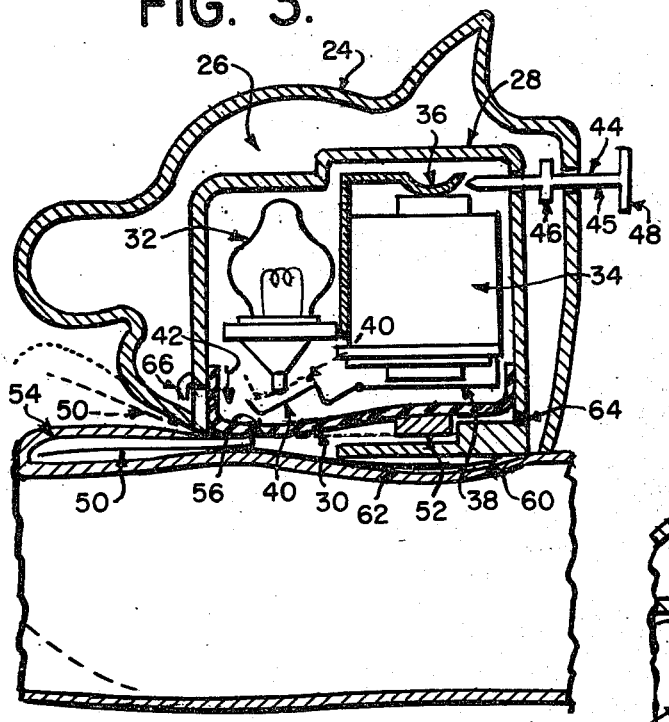
FIG. 3 is an enlarged fragmentary sectional view of the slipper of FIG. 1 taken along line 3—3.
Figure 5:
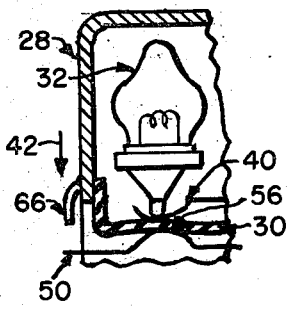
FIG. 5 is a fragmentary sectional view of a portion of the housing of FIG. 3 illustrating switch closure through the rubber seal interface portion of the housing.
Figure 4:
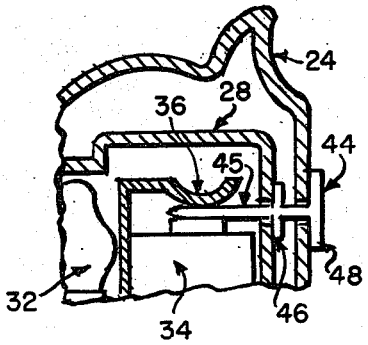
FIG. 4 is a fragmentary sectional view of a portion of the housing illustrated in FIG. 3, illustrating the operation of the day/night mode switch.

The night light 12 preferably comprises a light transmissive three dimensional hollow recognizable character rendition 24, such as the cat face illustratively shown in FIGS. 1–4, which, as will be described in greater detail hereinafter, is capable of being periodically illuminated by illumination apparatus 26 with each step by the child so as to reassure the child of its presence. The illumination apparatus 26, such as shown in FIGS. 3–5, preferably includes a light transmissive housing 28, such as a transparent housing formed of a plastic whose base portion preferably includes a resilient seal interface member, such as preferably a rubber seal 30 which completes the surrounding wall of the housing 28 so as to preferably make the interior of the housing waterproof while preventing leakage therefrom. As will be described in greater detail hereinafter, rubber seal 30 is preferably disposed so as to to enable actuation of the light source 32 through the rubber seal 30.

As shown and preferred in FIG. 3, the illumination apparatus 26 preferably contains the aforementioned light source 32, a conventional battery source 34 for powering the light source 32 and a switch 40, all of which are preferably mounted within the interior of the housing 28. A pair of electrical contacts 36 and 38 are provided for electrically connecting the battery 34 to the light source 32. One of the terminals of the battery 34 is connected to the switch 40 which preferably merely consists of a resiliently biased electrical contact which is normally biased in the direction of arrow 42 so as to normally provide an open circuit condition between light source 32 and battery source 34. In addition, a day/night mode switch 44, which preferably consists of a slide 45 formed of plastic or some other suitable electrical insulator, is preferably slidably mounted in the housing 28 and in the surrounding wall forming the hollow character rendition 24 adjacent the other contact 36. Thus, when the slider switch 44 is slidably pushed forward it will be positioned between contact 36 and the battery 34 so as to insulate contact 36 from battery 34 and create an open circuit condition at this point irrespective of the electrical condition of switch 40. This open circuit condition is illustrated in FIG. 4. As further shown and preferred in FIG. 3, the switch 44 preferably includes transverse projections 46 and 48 extending from slider 45. These projections 46, 48 assist in holding slider 45 in position and act as stops for the movement of the slider 45. Thus, switch 44 comprises a day/night mode switch with the day mode being illustrated in FIG. 4, that is with the operation of the light source disabled during the daytime, such as when the night light 12 is not desired, and with the switch 44 being shown in the night mode in FIG. 3 so that the light source 32 may be enabled during the nighttime to provide the aforementioned night light 12.

Figure 6:
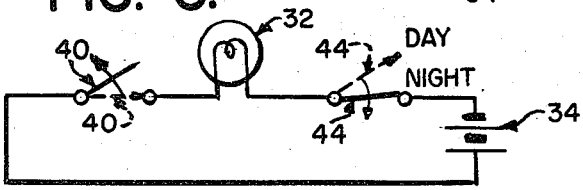
FIG. 6 is a schematic representation of the circuit associated with the housing of FIG. 3.

Switch 40, shown and preferred in FIGS. 3 and 5, is selectively actuated by means of a resilient pusher member 50, such as one formed of thin resilient metal which is cantilevered to housing 28, such as through a rubber washer 52. This resilient pusher member 50 preferably is mounted in a pocket portion 54 located in the front portion 20 of the slipper 10 and is positioned in this pocket portion 54 so as to engage in direct flexing movement in conjunction with the flexing of the bottom sole portion 14 of the slipper 10 during each step by the child. Actuation of the switch 40 is accomplished by means of a protrusion 56 which is disposed on pusher member 50 adjacent the switch 40 beneath the rubber seal 30 which forms an interface therebetween so as to enable electrical closure of switch 40 through the rubber seal 30. As shown and preferred in FIG. 3, in the unflexed condition of the slipper 10, protrusion 56 is out of contact with switch 40 thereby enabling switch 40 to remain biased to the open circuit condition schematically illustrated in FIG. 6. When the child takes a step, such as illustrated by FIG. 2, the bottom sole portion 14 of the slipper 10 flexes and the housing 28 moves downward in the direction of arrow 42 so as to cause protrusion 56 to bear against switch 40 through rubber seal interface 30 sufficiently so as to overcome the biasing force of switch 40 and cause electrical contact to be made between switch 40 and the base of light source 32 while also causing electrical contact 38 to bear against battery 34 thereby completing the electrical conduction path to light source 32, assuming day/night mode switch 44 has not been enabled, such as represented by FIG. 3. Such a closed circuit condition is represented in FIG. 6 by the dotted line position of switch 40 and the solid line position of switch 44. The actual electrical closure of switch 40 through the rubber seal interface 30 is illustrated in FIG. 5.

As can be seen with reference to FIGS. 4 and 6, if the day/night mode switch 44 is enabled by pushing switch 44 inward so as to disrupt or disable the electrical contact between electrical contact 36 and the battery 34, represented by the dotted lines 44 in FIG. 6, then the electrical conduction path to light source 32 cannot be completed when switch 40 is closed. Thus, as previously mentioned, day/night mode switch 44 permits the operation of light source 32, and hence night light 12, to be selectively disabled during the daytime when the night light 12 is not normally desired while permitting the light source 32 to be illuminated by closure of switch 40 during the nighttime when an accompanying night light is normally desired by the child.

As further shown and preferred in FIG. 3, the entire housing 28 can be removably mounted to the slipper 10 by any conventional mounting means such as a spring clip 60 insertable in a pocket 62 in the slipper 10, or by a snap or by Velcro strips, by way of example. Such removal will facilitate removal and replacement of the battery 34. In addition, removal and replacement of the battery 34 may be facilitated by providing a conventional hinge 64 in the surrounding wall 28 of the housing at one end with a conventional hook closure 66 at the other end of the housing 28.

By employing the child's slipper arrangement of the present invention, a night light is provided which accompanies the child and which is periodically illuminated with each step by the child, conserving battery life while reasurring the child. Moreover, such an arrangement is provided in a safe and efficient housing which is essentially waterproof so as to avoid battery leakage out of the housing and water entry into the housing while still permitting electrical closure of the switch with each step of the child. Thus, a safe and efficient portable night light slipper is provided.

What is claimed is:

1. In a child's slipper having illumination means associated therewith for lighting a path to be traversed by said child's slipper as the child wearer thereof travels along a walking surface step-by-step, said child's slipper having a front portion, a rear portion and a bottom sole portion, said bottom sole portion being bendable so as to flex with each step taken by said child wearer, said front portion forming a pocket for the front portion of the foot of said child wearer with said flexible bottom sole portion, said illumination means comprising a housing disposable on said front portion, a light source, a battery source for powering said light source upon completion of an electric conduction path therebetween and a switch means for selectively connecting said battery source to said light source in said electrical conduction path, said light source, battery source and switch means being disposable in said housing; the improvement comprising a resilient pusher member mountable in said front portion for direct flexing movement in conjunction with said flexing of said bottom sole portion during each step by said child wearer, said pusher member being disposed adjacent said switch means for actuating said switch means during each flexure of said pusher member so as to close said switch means during each step by said child wearer, and a light transmissive three dimensional hollow recognizable character rendition, said illumination means being disposable in said recognizable character rendition for illuminating said recognizable character rendition each time said light source is illuminated, said recognizable character rendition comprising a child's night light capable of being periodically illuminated with each step by said child, whereby said night light accompanies said child wearer during said path traversal.

2. A child's slipper in accordance with claim 1 wherein said illumination means further comprises means for selectively disabling the operation of said light source for preventing said illumination when said switch means closes by preventing completion of said electrical conduction path, said disabling means having a day/night mode for permitting said light source operation to be selectively disabled during the daytime when said night light is not desired and enabled by said pusher member during the nighttime when said accompanying night light is desired by said child wearer.

3. A child's slipper in accordance with claim 1 wherein said housing comprises a surrounding wall, said surrounding wall comprising a resilient seal interface member disposed between said switch means and said resilient pusher member for sealing said housing interior to ambient, said resilient pusher member actuating said switch means through said seal interface member, whereby electrical closure of said switch means through said seal interface member enables said housing interior to be insulated from said ambient during said electrical closure thereof.

4. A child's slipper in accordance with claim 1 wherein said housing is removably mountable to said front portion.

5. A child's slipper in accordance with claim 4 wherein said front portion comprises a pocket, said resilient pusher member being disposable in said pocket.

6. A child's slipper in accordance with claim 1 wherein said housing comprising means for enabling removal and replacement of said battery source therein.

7. A child's slipper in accordance with claim 2 wherein said battery source comprises a pair of electrical contacts, said disabling means comprising a slidable insulator means selectively disposable between one of said electrical contacts and said battery source for preventing completion of said electrical conduction path between said battery source and said light source.

8. A child's slipper in accordance with claim 3 wherein said resilient pusher member has one end thereof connected to said housing, said pusher member being cantilevered from said connected end.

9. A child's slipper in accordance with claim 3 wherein said surrounding wall comprises a light transmissive medium portion and said seal interface member.

10. A child's slipper in accordance with claim 9 wherein said surrounding wall light transmissive medium comprises a plastic.

11. A child's slipper in accordance with claim 3 wherein said seal interface member comprises a rubber seal.

12. A child's slipper in accordance with claim 11 wherein said housing is waterproof.

* * * * *